United States Patent [19]

Malm

[11] Patent Number: 4,610,557

[45] Date of Patent: Sep. 9, 1986

[54] MECHANICAL PENCIL WITH GROOVE AND LUG STRUCTURE

[75] Inventor: Curtis L. Malm, Braintree, Mass.

[73] Assignee: The Gillette Company, Boston, Mass.

[21] Appl. No.: 747,587

[22] Filed: Jun. 24, 1985

Related U.S. Application Data

[63] Continuation of Ser. No. 578,734, Feb. 9, 1985, abandoned.

[51] Int. Cl.[4] ..... B43K 21/08; B43K 21/06

[52] U.S. Cl. ..... 401/75; 401/76; 401/77; 401/78; 401/86; 401/87

[58] Field of Search ..... 401/54, 75, 76, 77, 401/78, 68, 87, 86

[56] References Cited

U.S. PATENT DOCUMENTS

| | | | |
|---|---|---|---|
| 1,546,490 | 7/1925 | Kahn | 401/78 |
| 1,627,602 | 5/1927 | Goldsmith | 401/77 |
| 1,716,953 | 6/1929 | Dunne | 401/77 |
| 1,774,699 | 9/1930 | Chelton | 401/77 |
| 2,161,889 | 6/1939 | Schaefer . | |
| 2,356,509 | 8/1944 | Deli . | |
| 2,563,128 | 8/1951 | Merryman . | |
| 2,866,438 | 12/1958 | Schischkow . | |
| 3,771,882 | 11/1973 | Kapilow . | |
| 4,136,980 | 1/1979 | Leem . | |

FOREIGN PATENT DOCUMENTS

| | | | |
|---|---|---|---|
| 463498 | 3/1950 | Canada | 401/77 |
| 454572 | 3/1925 | Fed. Rep. of Germany | 401/75 |
| 478303 | 3/1925 | Fed. Rep. of Germany | 401/75 |
| 266391 | 1/1950 | Switzerland | 401/77 |
| 16524 | of 1914 | United Kingdom | 401/78 |

*Primary Examiner*—Steven A. Bratlie
*Attorney, Agent, or Firm*—John P. Morley

[57] ABSTRACT

A low-cost mechanical pencil employing an improved lead-driving mechanism in which there is cooperation between a low-cost, helical spring member through which moves a lead advance-retract member which is keyed to longitudinal grooves in the inner barrel wall. If the lead is subjected to excessive pressure during use, it is caused to partially retract into the tip by virtue of axial compression of the helical spring, thereby reducing the likelihood of lead breakage.

3 Claims, 4 Drawing Figures

MECHANICAL PENCIL WITH GROOVE AND LUG STRUCTURE

This application is a continuation of application Ser. No. 578,734, filed Feb. 9, 1985, now abandoned.

BACKGROUND OF THE INVENTION

For many years, the lower-priced end of the pencil market has been dominated by conventional wooden pencils with mechanical pencils being unable to secure but a minor portion of the market. A number of factors have contributed to this division of market share, most importantly, the relative expense of the mechanical pencils which have been made available requiring that they be regarded as nondisposable items. Many attempts have been made to develop a simplified mechanical pencil which can compete with the less expensive wood pencils. Such pencil would overcome the disadvantages of the need to sharpen the point and the fact that the entire length of the wooden pencil is not usable. Although some of the designs for disposable mechanical pencils in the prior art would appear to be less expensive to manufacture than conventional mechanical pencils, they are still generally much more expensive than the common wooden pencil and hence have not been able to acquire a significant share of that market.

Among such designs is that shown in U.S. Pat. No. 3,771,882, which employs a longitudinally movable finger projecting from the side of the pencil barrel to advance the lead as it is consumed during use.

The design shown in U.S. Pat. No. 3,806,262 attempts to simplify a mechanical pencil design by eliminating the need for finger-actuated advancement of the lead, relying instead on a translating member mounted within a flexible tubular pencil barrel to translate deformation forces applied to the pencil barrel by the fingers to axially advance the lead as needed.

The mechanical pencil described in U.S. Pat. No. 4,136,980 attempts to simplify mechanical pencil construction in a manner in which the back and forth movements of the pencil lead are controlled by a lead carrier having a spiral guide travelling along the spiral grooves formed on the inside of the pencil barrel and moving in response to manual rotation of the cap which holds one end of the supporting member.

Most of the mechanical pencils which have been commercialized successfully have relied upon the use of a helical feed mechanism to advance or retract the lead in response to the relative rotation of the body of the pencil and either its tip or cap. Such pencils are exemplified in U.S. Pat. Nos. 2,161,889; 2,356,509; 2,563,128; and 2,866,438.

While it has generally been felt by those skilled in the art that a helical advance-retract mechanism could not be produced economically enough for use in a disposble mechanical pencil, there has now been discovered a construction which may be manufactured in large volume at a low enough price to compete more effectively with the conventional wooden pencil.

SUMMARY OF THE INVENTION

The present invention relates to a low-cost mechanical lead pencil adapted for low-cost, mass production and overcoming the disadvantages of prior art devices. The pencil of the present invention provides an improved lead driving mechanism involving cooperation between a low-cost, helical spring member through which moves a lead advance-retract member which is keyed to longitudinal grooves in the inner barrel wall. The construction is such that excessive pressure on the pencil lead during use will cause the lead to be partially retracted into the tip by virtue of axial compression of the helical spring, thereby reducing the likelihood of lead breakage.

DESCRIPTION OF THE PREFERRED EMBODIMENTS

Figure 1:
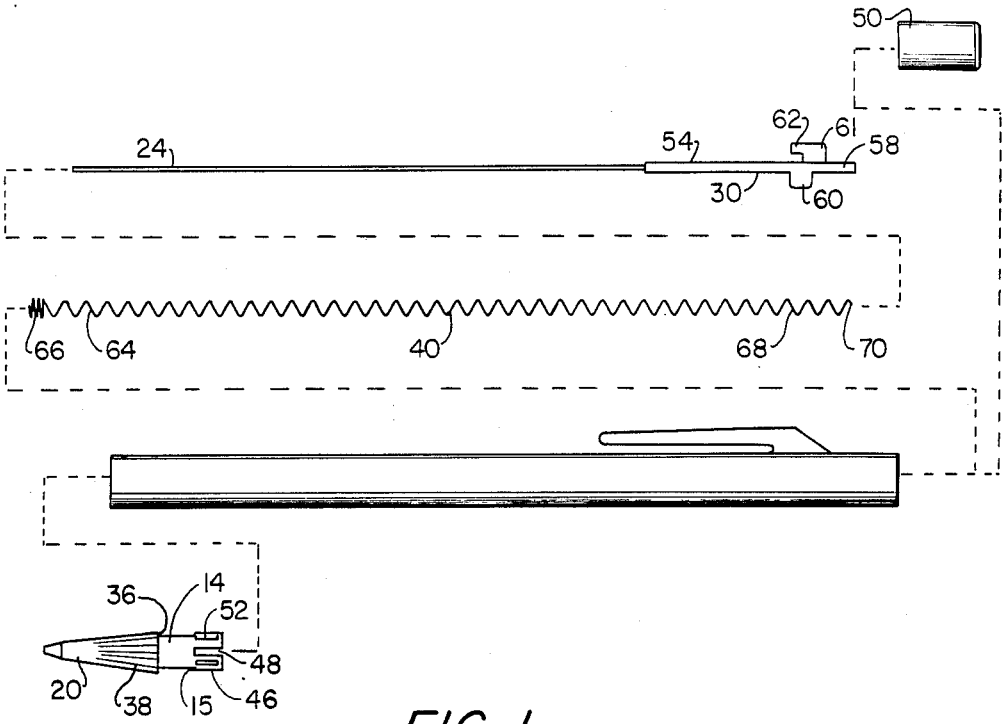
FIG. 1 is an exploded view of a complete embodiment of the operating mechanism of a mechanical pencil in accordance with the present invention.

Referring to FIG. 1, the mechanical pencil of this invention comprises five essential parts, a hollow barrel 10, a rotatable tip 20, a lead advance-retract member 30, a helical metal spring 40, and an eraser or barrel plug 50.

Figure 4:
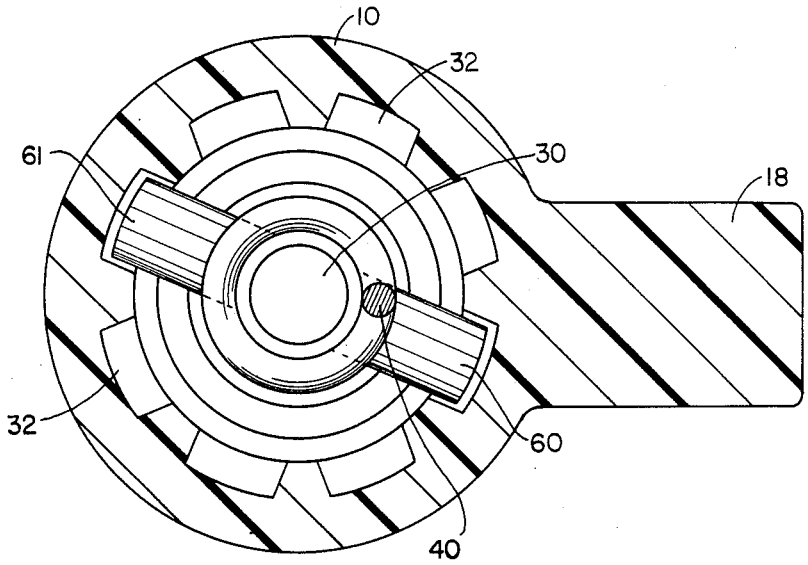
FIG. 4 is a sectional view in enlarged scale taken on line 4—4 of FIG. 2.
Figure 2:
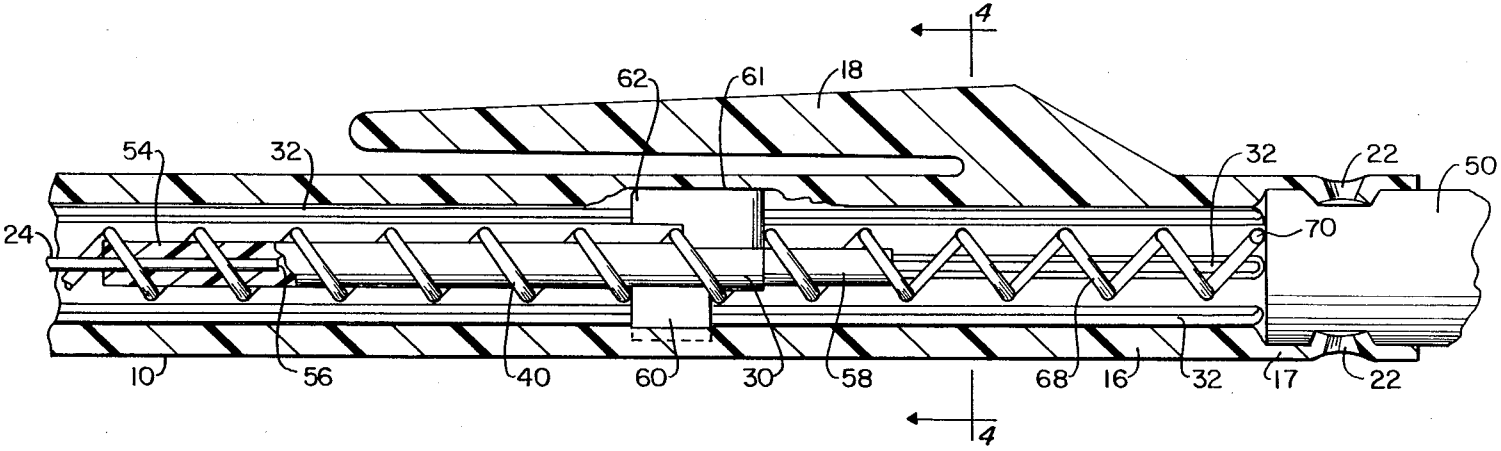
FIG. 2 is a sectional view inside elevation of the rearward portion of a mechanical pencil of this invention illustrating the operation of the lead advance-retract mechanism.
Figure 3:
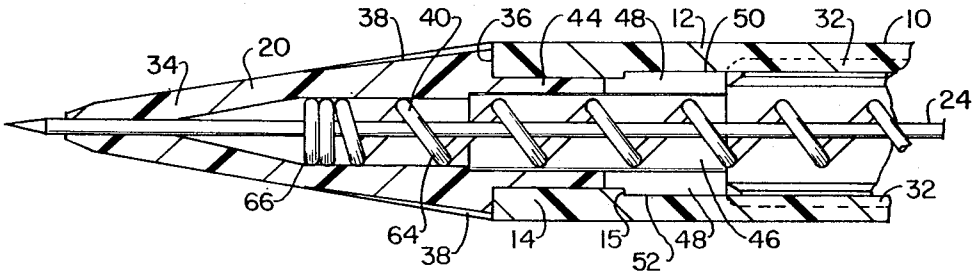
FIG. 3 is a sectional view inside elevation of the forward portion of a mechanical pencil of this invention illustrating the operation of the lead advance-retract mechanism.

Referring now to FIGS. 2–4, the hollow barrel 10 of the mechanical pen comprises a forward end 12 terminated by a bore portion 14 of reduced inside diameter and a rearward end 16 terminated by a bore portion 17 of increased diameter within which are located dimples 22 which serve to frictionally retain eraser 50. Mounted near the rearward end of barrel 10 is integrally molded clip member 18, which serves to retain the mechanical pencil in a pocket or the like when it is not in use. Located axially within the bore of barrel 10 are helical spring 40 typically of metal, lead advance-retract member 30, and lead 24. Located on the inner wall of hollow barrel 10 are longitudinal grooves 32, the purpose of which will be made clear hereinafter.

Referring to FIG. 3, tip 20 comprises conical forward portion 34 bearing finger-gripping grooves 38 (best seen in FIG. 1) and terminating at shoulder 36. Rearward portion 44 of tip 20 comprises skirt 46 split by slots 48 and which bears lugs 52 to form a discontinuous shoulder which during assembly abuts shoulder 15 formed by bore portion of reduced inside diameter 14.

Lead advance-retreat mechanism 30 comprises forward end 54 within which is located lead holding bore 56 within which is frictionally retained lead 24. Mounted on rearward end 58 of lead advance-retract member 30 are lugs 60 and 61 which mate with barrel grooves 32 as shown best in FIG. 4. Contiguous with a lug 61 is lug lead portion 62 which serves to reduce assembly problems by insuring that both of the lugs 60 are simultaneously aligned wtih grooves 32 during assembly.

Located axially within the bore of hollow barrel 10 is helical spring 40 which comprises forward portion 64 which is terinated by turns of reduced pitch 66 which are keyed by frictional engagement with hollow bore of tip 20 and rearward portion 68 terminated by open turn 70.

In operating the pencil to advance or retract the lead, barrel 10 and tip 20 are rotated with respect to each other. In so doing, spring 40 is caused to rotate with tip 20 by virtue of the friction fit of spring turns of reduced pitch 66. At the same time, lead advance-retract member 30 is caused to rotate with barrel 10 by the keying action of lugs 61 and longitudinal grooves 32 on the inner wall of the barrel. As a result, the rotational movement of tip 20 and helical spring 40 is converted to longitudinal movement of lead advance-retract member 30 as the rotating turns of the spring bear upon lug 60 as shown in FIG. 2.

From the foregoing, it will be seen that there has been provided a practical mechanical pencil of very simple construction, requiring a limited number of parts and adapted for low-cost mass production.

I claim:

1. A mechanical pencil adapted for low-cost, mass production and providing simplified assembly procedures comprising a hollow barrel member carrying a plurality of longitudinal grooves on the inner wall thereof spaced apart from each other, a tip rotatably mounted on the barrel member, a helical spring member located axially within the barrel member and a lead advance-retract mechanism comprising a body having forward and rearward ends, said forward end including a lead holding bore to frictionally retain an end portion of a length of lead whereby the remaining portion of the length of lead can extend coaxially through the helical spring from the lead holding bore to the tip, said rearward end carrying a plurality of solid lugs projecting outwardly from the body and spaced apart from each other about the body, one of said lugs including a lead portion defined by an extention extending toward said forward end and where the extension is spaced apart from the body of the advance-retract mechanism along the entire length of the extension so that said advance-retract mechanism is positioned within the helical spring and the helical spring passes between the extension and the body of the advance-retract mechanism and where the spacing between the longitudinal grooves and the lugs carried by the rearward end of the advance-retract mechanism is arranged so that insertion of the lead portion into one of the grooves simultaneously aligns the other lug in another groove and where relative movement between the barrel and tip members is converted to longitudinal movement of the lead advance-retract mechanism by virtue of cooperation between the lugs and grooves.

2. A mechanical pencil of claim 1 where the hollow barrel member carrys at least four longitudinal grooves.

3. A mechanical pencil of claim 1 where the grooves are spaced apart from each other to provide pairs of opposed grooves and where the opposed grooves are spaced apart from each other by a distance substantially equivalent to the distance which the lugs carried by rearward end of the advance-retract mechanism are spaced apart from each other so that insertion of the lead portion into one of the grooves of an opposed pair simultaneously aligns the other lug in the other groove of the opposed pair.

* * * * *